United States Patent [19]

Bui

[11] 4,291,212

[45] Sep. 22, 1981

[54] LAMP SOCKET SWITCH OPERATOR EXTENSION

[76] Inventor: Tren V. Bui, 5243 SW. Idaho St., Portland, Oreg. 97221

[21] Appl. No.: 99,758

[22] Filed: Dec. 3, 1979

[51] Int. Cl.[3] ..... H01H 19/00; H01H 3/10

[52] U.S. Cl. ..... 200/331; 64/2 R; 74/10 A

[58] Field of Search ..... 200/329, 330, 331, 332, 200/335, 336, 337, 338; 74/10 A; 64/2 R

[56] References Cited

U.S. PATENT DOCUMENTS

| | | | |
|---|---|---|---|
| 1,004,182 | 9/1911 | Moore et al. | 200/331 |
| 1,367,042 | 2/1921 | Granville | 64/2 R |
| 1,601,099 | 9/1926 | Arens | 64/2 R |
| 2,036,948 | 4/1936 | McNary | 74/10 A |
| 2,853,897 | 9/1958 | Loewy | 74/10 A |

*Primary Examiner*—John W. Shepperd
*Attorney, Agent, or Firm*—Oliver D. Olson

[57] ABSTRACT

The horizontally extending rotary operator shaft of an electric lamp socket switch is joined releasably to one end of a connector the opposite end of which is connected through a coupler to one end of an elongated extension which hangs freely downward for rotation about a vertical axis. The coupler may be a length of snake chain, a length of link chain, wire, rotor or other flexible or resilient material confined for rotation in a rigid sleeve having its ends disposed at right angles to each other, or bevel gears disposed perpendicular to each other, or a link pivotally interconnecting the connector and extension and confined in a sleeve which maintains the included angles between the link and the connector and extension to obtuse angles of sufficient magnitude that, as with the other couplers, rotation of the extension about a vertical axis results in rotation of the connector and hence the rotary operator shaft of the switch about a horizontal axis.

9 Claims, 9 Drawing Figures

10
14
20
30
16
26
28
24
32
12
22
18
22'
34
9
46
50
56
54
52
48
A
B
20
28
36
38
40
42
44
62
64
58
60
66
68
70

LAMP SOCKET SWITCH OPERATOR EXTENSION

BACKGROUND OF THE INVENTION

This invention relates to electric lamp socket switches of the rotary shaft type, and more particularly to a freely hanging extension by which such rotary shaft may be disposed horizontally and operated at an extended position by rotation of the extension about a vertical axis.

In electric lamps of the floor and table types, wherein the lamp socket switch includes a rotary shaft fitted with a hand knob at its outer end, the hand knob usually is located under a lamp shade, or is otherwise inconveniently positioned for easy access and hand manipulation. In some instances, such as with swag lamps, the hand knob is elevated out of convenient reach.

A variety of switch operator extensions have been proposed heretofore in an effort to overcome the aforementioned difficulties. The extensions disclosed in U.S. Pat. Nos. 803,281 and 936,518 are suitable for use with lamp sockets which are elevated out of convenient reach, but the lamp socket must be tilted at an angle to vertical, because the axis of rotation of the extension must be maintained at a substantial obtuse angle with respect to the axis of rotation of the rotary shaft of the switch. The hand gripping portion of the extension disclosed in U.S. Pat. No. 519,354 can function with its rotational axis perpendicular to the rotational axis of the rotary shaft of a switch, but the coil spring coupling necessarily is so strong that when the hand gripping portion is not held by a hand, the coil spring swings it outward toward alignment of its axis with the axis of the rotary shaft. If a lamp shade were in the way, the hand gripping portion would engage and possibly damage it. In any case, the hand gripping portion will not hang freely downward for most convenient access.

SUMMARY OF THE INVENTION

In its basic concept, this invention provides a lamp socket switch operator extension by which the horizontally extending rotary shaft of an electric lamp socket switch is rotatable about its horizontal axis by rotation of a freely depending extension about a vertical axis.

It is by virtue of the foregoing basic concept that the principal objective of this invention is achieved; namely, to overcome the aforementioned disadvantages and limitations of prior lamp switch operator extensions.

Another object of this invention is to provide a lamp switch operator extension of the class described that is versatile in its use with a variety of types of rotary shaft lamp socket switches and a variety of styles of lamps.

A further object of this invention is the provision of a lamp switch operator extension of the class described that is of simplified construction for economical manufacture, is attachable to lamps with speed and facility, and is attractive in appearance whereby to enhance the beauty of a lamp.

The foregoing and other objects and advantages of this invention will appear from the following description, taken in connection with the accompanying drawing of preferred embodiments.

DESCRIPTION OF THE PREFERRED EMBODIMENTS

Figures 1, 2, 3, 4, 5, 6, 7, 8, 9:
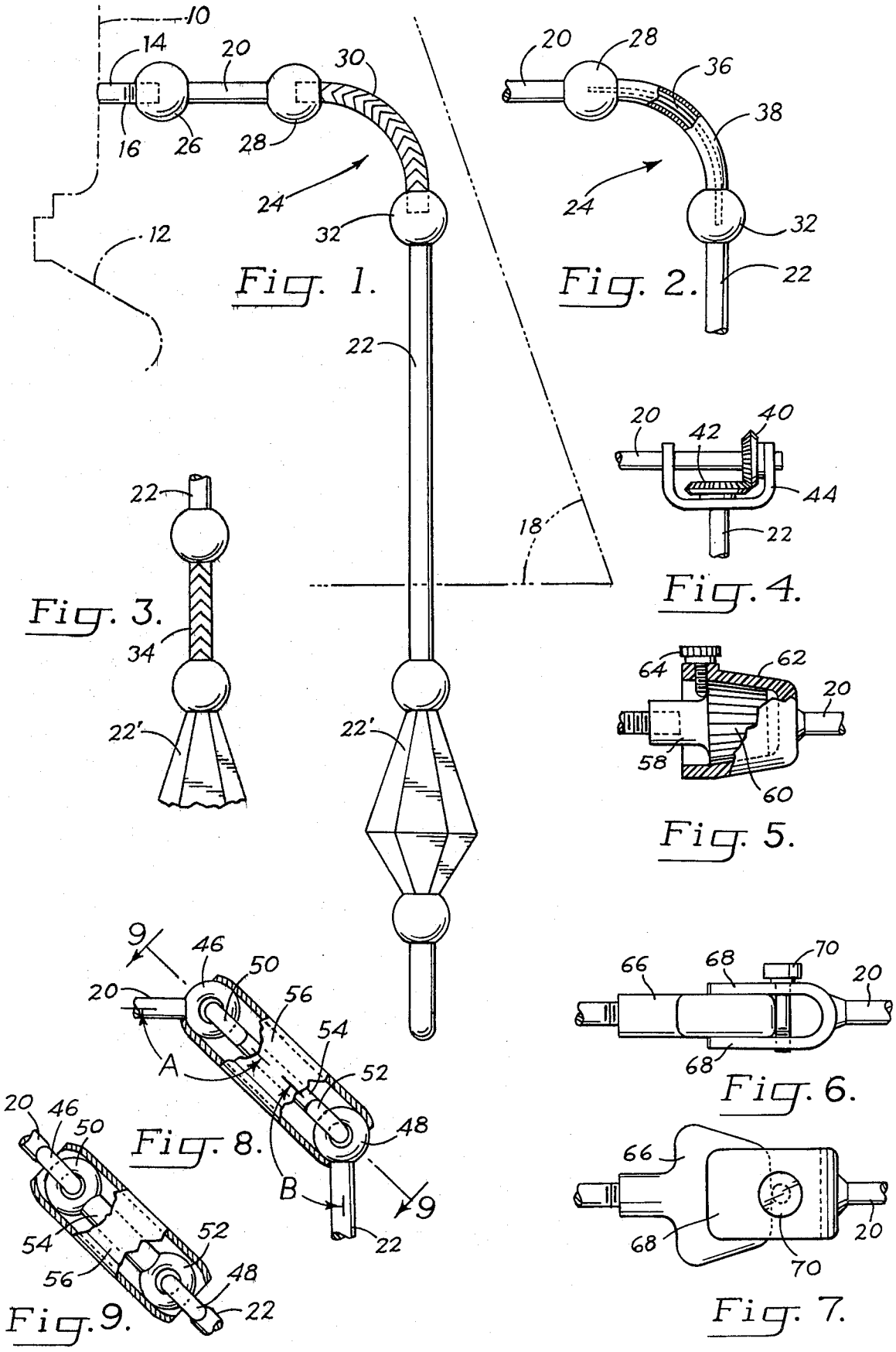
FIG. 1 is a vertical elevation of a lamp switch operator extension embodying the features of this invention, illustrated in association with a lamp socket and shade shown in broken lines, the extension incorporating a length of snake chain as a flexible coupler.
FIG. 2 is a fragmentary vertical elevation of a modification of the switch operator extension of FIG. 1, wherein a second length of snake chain is incorporated into the extension component adjacent the hand gripping portion, to increase maneuverability of the latter.
FIG. 3 is a fragmentary vertical elevation of a resilient form of coupler as an alternative to the snake chain coupler of FIG. 1.
FIG. 4 is a fragmentary vertical elevation of a bevel gear form of coupler as a further alternative to the snake chain coupler of FIG. 1.
FIG. 5 is a fragmentary vertical elevation of a connector component of the operator extension for connecting the latter to the rotary hand knob of an electric lamp switch, a portion being broken away to disclose internal structural details.
FIG. 6 is a fragmentary plan view of another form of connector component.
FIG. 7 is a fragmentary side elevation as viewed from the bottom in FIG. 6.
FIG. 8 is a fragmentary side elevation of an articulated linkage form of coupler as a still further alternative to the snake chain coupler of FIG. 1.
FIG. 9 is a fragmentary sectional view taken on the line 9—9 in FIG. 8.

For purposes merely of illustration, FIG. 1 of the drawing shows, in broken lines, an electric lamp socket 10 extending vertically upward from a lamp base 12 which may be of the floor type or of the table type. Extending laterally outward from the socket is the rotary operator shaft 14 by which the switch is turned on and off.

Ordinarily, the outer end of the shaft 14 mounts a finger gripping knob, to facilitate rotation of the shaft. It is usually mounted on the shaft by means of interengaging threads 16. FIGS. 5, 6 and 7 illustrate two forms of such knobs, to be discussed in detail hereinafter.

As will be understood, a lamp shade 18 is associated with the lamp, being supported either by the socket 10 or by a light bulb mounted in the socket. The bottom side of the lamp shade may be spaced vertically below the rotary shaft 14 to widely varying distances, depending upon the size and style of the shade. In most instances, the finger gripping knob on the end of the operator shaft 14 is disposed up under the bottom edge of the lamp shade sufficiently to be awkward or otherwise inconvenient to reach for easy manipulation.

Referring now primarily to FIG. 1 of the drawings, the lamp socket switch operator extension illustrated therein includes a connector member 20 arranged for releasable connection at one end to the rotary shaft 14, for rotation with and about the same axis as said rotary shaft. The operator extension also includes an elongated extension member 22 having one end portion 22' configured to facilitate gripping by the fingers for rotating the extension member about its longitudinal axis.

The switch operator extension also includes a coupler 24 which functions to interconnect the end of the connector member 20 opposite the rotary shaft 14 and the end of the extension member 22 opposite the finger gripping end portion 22'.

In accordance with this invention, the coupler member is characterized by allowing the extension member 22 to hang freely downward by gravity from the connector member 20 and to be rotated about its longitudinal axis to rotate the connector member 20 simultaneously therewith when the axis of rotation of the connector member 20 is disposed perpendicular to the axis of rotation of the extension member 22.

In the specific embodiment illustrated in FIG. 1, the connector member 20 is provided in the form of a relatively short rod formed with enlarged heads 26 and 28 at its opposite ends. The head 26 is provided with an internal bore threaded to match the threads 16 on the projecting end of the shaft 14. By this means the connector replaces the conventional knob ordinarily employed in rotating the shaft.

The head 28 at the opposite end of the connector rod is joined to one end of the coupler 24. In the embodiment illustrated in FIG. 1, the coupler member is provided by a length of snake chain 30. As is well known, snake chain is made up of a multiplicity of longitudinally interconnected and articulated segments which provide the chain with the characteristic of longitudinal flexibility, without longitudinal resilience, while being rotationally substantially rigid. That is to say, when rotation of snake chain on its longitudinal axis is initiated at one end, the same rotation occurs substantially simultaneously at the opposite end.

The end of the length of snake chain 30 opposite its connection to the head 28, is secured to an enlarged head 32 on the end of the elongated extension 22 opposite the finger gripping end portion 22'. The latter portion preferably is provided in the form of attractive ornamentation, such as the diamond configuration illustrated.

It is to be noted from FIG. 1 that the length of snake chain allows the elongated extension 22 to hang freely downward by gravity, with the lower end portion 22' exposed conveniently for easy access for gripping between the fingers to rotate the extension on its vertically disposed longitudinally axis. As this axial rotation occurs, the snake chain coupler translates that rotation to the horizontally disposed connector 20 and the attached operator shaft 14.

In FIG. 2, an additional length of snake chain 34 is interposed between the lower end of the extension 22 and the ornamental end portion 22'. This allows the lower end portion to be bent angularly with respect to the longitudinal axis of the upper portion 22, thereby further facilitating operation of the extension.

In the embodiment illustrated in FIG. 3, the coupler 24 interconnecting the connector 20 and extension 22 is a length of longitudinally flexible as well as longitudinally resilient material 36 such as the wire illustrated, or cable, coil spring, synthetic thermoplastic resin, and others. It may also be a length of rubber of the type that is rotationally substantially rigid, in order to translate vertical axial rotation of the extension 22 to horizontal axial rotation of the connector 20.

In order for the coupler to be made of a length of resilient material, it is necessary to provide means for retaining it in the longitudinally bent condition illustrated in FIG. 3, in order to preserve the perpendicular or other desired angular relationship of the rotational axes of the connector 20 and extension 22. This is provided, in the embodiment illustrated in FIG. 3, by an arcuate sleeve 38 which confines freely within it the length of wire 36 extending between the heads 28 and 32 to which the terminal end portions of the wire are bonded.

The arcuate sleeve is provided with opposite ends which are disposed at the desired angles to each other. As illustrated, this is a right angle. Further, these terminal ends of the sleeve are disconnected from the confronting heads 28 and 32, to allow axial rotation of the connector and extension members and the interconnecting wire.

Another form of coupler is illustrated in FIG. 4. Thus, a pair of gears 40 and 42, preferably bevel gears as shown, are secured to the adjacent ends of the connector rod 20 and extension rod 22, respectively. They are retained in operative, meshing engagement at the illustrated right angles to each other, or at any other desired angle, by such means as the U-shaped supporting yoke 44 which is supported pivotally on the connector rod 20. The elongated extension rod 22 thus hangs freely downward by gravity.

Still another form of coupler is illustrated in FIGS. 8 and 9. In this form, the adjacent ends of the connector rod 20 and extension rod 22 are formed with eyelets 46 and 48, respectively. These eyelets are interconnected pivotally by means of eyelets 50 and 52, respectively, at the opposite ends of a link 54.

In order for vertical axial rotation of the extension rod 22 continuously in one direction to be translated into correspondingly continuous horizontal axial rotation of the connector rod 20 disposed at right angles to each other, it is necessary that the included angles A and B between the link 54 and connector rod 20 and between the link and extension rod 22 be maintained at obtuse angles of substantial magnitude. Although the angles preferably are made equal at 135°, they may vary between about 110° and about 160°. Thus, if angle A is 110°, then angle B will be 160°, and vice versa.

Maintenance of the obtuse angles just described is provided by means of a hollow sleeve 56 which encircles the link 54 and eyelets 50 and 52 and abuts at its opposite ends against the connector rod 20 and extension rod 22.

In the embodiment illustrated in FIG. 1, connection of the operator extension to the rotary shaft 14 of the lamp socket is provided by the interengaging threads on the shaft 14 and connector head 26. Means may be provided for making such connection without removal of the usual finger gripping knob conventionally provided on the projecting end of the shaft 14. Two such means are illustrated in the drawings.

In FIG. 5, the conventional knob 58 threaded to the shaft 14 is shown to be circular in cross section and provided with circumferentially spaced, outwardly projecting ribs 60 to enhance gripping between the fingers. For use with this type of knob, the confronting end of the connector rod 20 is provided with a hollow socket 62 configured to receive the knob therein. A set screw 64, mounted in a threaded opening in the socket, is arranged to releasably engage the shoulder formed between the ribbed portion and reduced diameter portion of the knob 58 to secure the connection.

In FIGS. 6 and 7, the finger gripping knob 66 conventionally provided on the operator shaft 14 is of the blade type, which is flat in profile. For use with this flat type of knob 66, a U-shaped clamp is secured to the adjacent end of the connector rod 20. The clamp provides a pair of resilient plates 68 spaced apart sufficiently to receive the flat knob 66 between them. A clamp screw 70 extends freely through a hole in one of the plates into threaded engagement with a threaded opening in the opposite plate. Thus, by rotating the clamp screw to draw the clamp plates together, the flat knob 66 is clamped firmly between them.

The ornamentation provided by the diamond configuration illustrated in FIG. 1 is enhanced by making the extension rod 20, 22' of clear synthetic thermoplastic resin, preferably methylmethacrylate or others providing similar optical properties. It has been found that light emanating from a light bulb mounted in the socket 10 produces attractive light effects in the extension rod.

From the foregoing, it will be appreciated that the present invention provides a simplified and economical lamp socket switch operator extension which, while hanging freely downward by gravity in a vertical position, is capable of being rotated on that vertical axis to effect axial rotation of the switch operator shaft on its horizontal axis. The extension is versatile in its applicability to lamps of many sizes and styles, is attachable with speed and facility and is an attractive addition to the lamp.

It will be apparent to those skilled in the art that various changes may be made in the size, shape, type, number and arrangement of parts described hereinbefore, without departing from the spirit of this invention.

Having now described my invention and the manner in which it may be used, I claim:

1. For use with an electric lamp socket switch having a rotary operator shaft extending laterally from the socket, a switch operator extension comprising:

(a) a connector member arranged for connection at one end to the rotary shaft of an electric lamp socket switch for rotation with and about the same axis as said rotary shaft, (b) an elongated extension member having one end portion arranged for gripping by the fingers for rotation of the extension member about its longitudinal axis, and (c) a coupler member interconnecting the end of the connector member opposite the rotary shaft and the end of the extension member opposite the finger gripping end portion, (d) the coupler comprising a length of snake chain characterized by being longitudinally flexible and rotationally substantially rigid and allowing the extension member to hang freely downward by gravity from the connector member and to be rotated about its longitudinal axis to rotate the connector member about its longitudinal axis simultaneously therewith when the axis of rotation of the connector member is disposed perpendicular to the axis of the extension member.

2. The switch operator extension of claim 1 wherein the outer end of the rotary shaft mounts an operator knob having an outer portion of round cross section and an inner portion of reduced diameter defining a shoulder therebetween, and the connector member includes a socket at one end arranged to receive the round outer portion of the knob, and a set screw on the socket arranged to releasably engage the shoulder, whereby the round outer portion of the knob is secured frictionally in the socket for rotation therewith.

3. The switch operator extension of claim 1 wherein the outer end of the rotary shaft mounts an operator knob which is flat in profile, and the connector member includes a clamp having a pair of spaced resilient plates arranged to receive the flat knob between them, and a clamp screw extending through one of the plates and threaded into the other plate in a position behind the knob for drawing the plates together and releasably clamping the knob between them.

4. For use with an electric lamp socket switch having a rotary operator shaft extending laterally from the socket, a switch operator extension comprising:

(a) a connector member arranged for connection at one end to the rotary shaft of an electric lamp socket switch for rotation with and about the same axis as said rotary shaft, (b) an elongated extension member having one end portion arranged for gripping by the fingers for rotation of the extension member about its longitudinal axis, and (c) a coupler member interconnecting the end of the connector member opposite the rotary shaft and the end of the extension member opposite the finger gripping end portions, (d) the coupler member comprising a length of longitudinally resilient and rotationally substantially rigid material, and an arcuate, hollow rigid sleeve encircling said length of resilient material and confined freely by the latter between and disconnected from the confronting ends of the connector and extension members, the coupler member being characterized by allowing the extension member to extend downward from the connector member and to be rotated about its longitudinal axis to rotate the connector member and length of resilient material simultaneously therewith relative to the sleeve when the axis of rotation of the connector member is disposed perpendicular to the axis of the extension member.

5. The switch operator extension of claim 4 wherein the outer end of the rotary shaft mounts an operator knob having an outer portion of round cross section and an inner portion of reduced diameter defining a shoulder therebetween, and the connector member includes a socket at one end arranged to receive the round outer portion of the knob, and a set screw on the socket arranged to releasably engage the shoulder, whereby the round outer portion of the knob is secured frictionally in the socket for rotation therewith.

6. The switch operator extension of claim 4 wherein the outer end of the rotary shaft mounts an operator knob which is flat in profile, and the connector member includes a clamp having a pair of spaced resilient plates arranged to receive the flat knob between them, and a clamp screw extending through one of the plates and threaded into the other plate in a position behind the knob for drawing the plates together and releasably clamping the knob between them.

7. For use with an electric lamp socket switch having a rotary operator shaft extending laterally from the socket, a switch operator extension comprising:

(a) a connector member arranged for connection at one end to the rotary shaft of an electric lamp socket switch for rotation with and about the same axis as said rotary shaft, (b) an elongated extension member having one end portion arranged for gripping by the fingers for rotation of the extension member abouts its longitudinal axis, and (c) a coupler member interconnecting the end of the connector member opposite the rotary shaft and the end of the extension member opposite the finger gripping end portion, (d) the coupler member comprising a link member connected pivotally at its opposite ends one to the connector member and the other to the extension member, and a hollow sleeve encircling the link member and abutting at its opposite ends one against the connector member and the other against the extension member for limiting the included angle between the link member and the connector member and between the link member and the extension member to obtuse angles which allow axial rotation of the connector and extension members continuously in one direction, the coupler member being characterized by allowing the extension member to extend downward from the connector member and to be rotated about its longitudinal axis to rotate the connector member about its longitudinal axis simultaneously therewith when the axis of rotation of the connector member is disposed perpendicular to the axis of the extension member.

8. The switch operator extension of claim 7 wherein the outer end of the rotary shaft mounts an operator knob having an outer portion of round cross section and an inner portion of reduced diameter defining a shoulder therebetween, and the connector member includes a socket at one end arranged to receive the round outer portion of the knob, and a set screw on the socket arranged to releasably engage the shoulder, whereby the round outer portion of the knob is secured frictionally in the socket for rotation therewith.

9. The switch operator extension of claim 7 wherein the outer end of the rotary shaft mounts an operator knob which is flat in profile, and the connector member includes a clamp having a pair of spaced resilient plates arranged to receive the flat knob between them, and a clamp screw extending through one of the plates and threaded into the other plate in a position behind the knob for drawing the plates together and releasably clamping the knob between them.

* * * * *